US006367102B1

(12) United States Patent
McMullen

(10) Patent No.: US 6,367,102 B1
(45) Date of Patent: Apr. 9, 2002

(54) DRAIN ASSEMBLY WITH INSTALLATION AID STOPPER GUIDE

(75) Inventor: Mark F. McMullen, Adell, WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 09/778,410

(22) Filed: Feb. 7, 2001

(51) Int. Cl.[7] ..... E03C 1/232

(52) U.S. Cl. ..... 4/684; 4/688; 4/689; 4/691; 4/286

(58) Field of Search ..... 4/684, 685, 688, 4/689, 690, 691, 692, 693, 694, 286, 288, 292, 293, 295, DIG. 14

(56) References Cited

U.S. PATENT DOCUMENTS 2,063,399 A * 12/1936 Rasmussen
2,282,212 A 5/1942 Pope ..... 4/194
2,479,485 A * 8/1949 Frank
3,287,742 A 11/1966 Gaddis ..... 4/191
3,333,815 A * 8/1967 Downey et al.
4,006,498 A * 2/1977 Cuschera
5,819,328 A * 10/1998 Lewis
6,138,290 A * 10/2000 Lin

* cited by examiner

*Primary Examiner*—David J. Walczak
*Assistant Examiner*—Khoa Huynh
(74) *Attorney, Agent, or Firm*—Quarles & Brady LLP

(57) ABSTRACT

A drain assembly mountable in a drain opening of a wash basin includes a movable stopper guide that can be used during installation to align the drain flange to the drain body from above the sink. The stopper guide supports at an upper end a stopper for closing the drain opening. The stopper guide has an axial opening accommodating an axial fastener joining the drain flange and drain body to the basin. The stopper guide also has downwardly extending legs defining an axial slot extending from the axial opening for accommodating cross-members extending laterally between each of the drain flange and drain body. The drain flange can be aligned to the drain body by engaging the drain flange cross-member and rotating it as needed. A method of installing a drain assembly to a basin is also disclosed.

8 Claims, 2 Drawing Sheets

DRAIN ASSEMBLY WITH INSTALLATION AID STOPPER GUIDE

CROSS-REFERENCE TO RELATED APPLICATIONS

Not applicable.

STATEMENT REGARDING FEDERALLY SPONSORED RESEARCH/DEVELOPMENT

Not applicable.

BACKGROUND OF THE INVENTION

The present invention relates to plumbing fixtures, and more particularly to drain assemblies used to control the flow of fluid through a drain opening of a basin.

Conventional drain assemblies can often require the installer to connect the components of the assembly from beneath the sink on typically cramped, dark spaces. Thus, drain assemblies that can, to some extent, be assembled from above the basin are desirable.

For example, U.S. Pat. No. 2,282,212 discloses a drain assembly having a drain flange that fits down into the drain opening from above the basin. The drain flange has a threaded end that threads into the valve body positioned beneath the sink. A drawback of this assembly is that the connection of the valve body to the drain flange must be made below the basin.

The drain assembly disclosed in U.S. Pat. No. 3,287,742 uses a separate threaded fastener aligned axially at the center of the opening and connected at its ends to cross members of the drain flange and the waste housing positioned beneath the basin. The fastener can be assembled and tightened from above the basin. This assembly, however, does not provide for use with a movable drain stop operated by a lever mechanism.

An improved drain assembly having a movable drain stop is desired that can to a greater extent be assembled and installed from above the basin.

BRIEF SUMMARY OF THE INVENTION

One aspect of the invention provides a drain assembly for controlling flow through a drain opening. There is a drain body having an upper rim and a laterally extending cross-member with an opening therein. There is also a flange having a bottom rim and a laterally extending cross-member with an opening capable of being positioned in registration with the cross-member opening of the drain body. An axial fastener is simultaneously positionable in the flange opening and drain body opening.

There is also a stopper guide having an axial opening for accommodating the fastener which is axially movable in the flange and drain body. The stopper guide has downwardly extending legs defining an axial slot there between for accommodating the flange and drain body cross members. Another part of the assembly is a stopper connectible to an upper portion of the stopper guide and sized to seal against the flange.

In preferred forms the drain body defines a gasket support area at its upper end around the upper rim, an upper end of the stopper guide has a connection member for engaging the stopper, the connection member permits removably securing the stopper to the stopper guide, and the connection member includes a plurality of upwardly extending fingers having latch surfaces for engaging catch surfaces on the underside of the stopper.

In another aspect the invention provides a method of installing a drain assembly in a drain opening of a basin. One temporarily mounts a drain body to the drain opening from beneath the basin. On then inserts a drain flange into the drain opening from above the basin. Next, one aligns the drain flange to the drain body by inserting a stopper guide into the drain opening and rotating the drain flange with the stopper guide. One then fastens the drain flange and the drain body to the basin with an axial fastener inserted through an opening in the stopper guide. Finally, one connects a stopper onto an upper end of the stopper guide.

The present invention provides a drain assembly having a "pop-up" type stopper suitable to be operable by the usual drain valve lever mechanism. However, it can be quickly and easily installed to a basin, primarily from above the basin. The unique stopper guide can be used during installation to align the drain flange and drain body and hold them in the proper alignment while being secured together and to the basin. The stopper guide can then be removed so that the stopper can be quickly snapped or threaded onto its upper end and then dropped back into the drain opening for attachment to a valve stem of a conventional ball-type control mechanism.

The foregoing and still other advantages of the invention will appear from the following description. In that description reference is made to the accompanying drawings which form a part hereof and in which there is shown by way of illustration a preferred embodiment of the invention. That embodiment does not represent the full scope of the invention. Rather, the claims should be looked to in order to judge the full scope of the invention.

DETAILED DESCRIPTION OF THE PREFERRED EMBODIMENT

Figure 1:
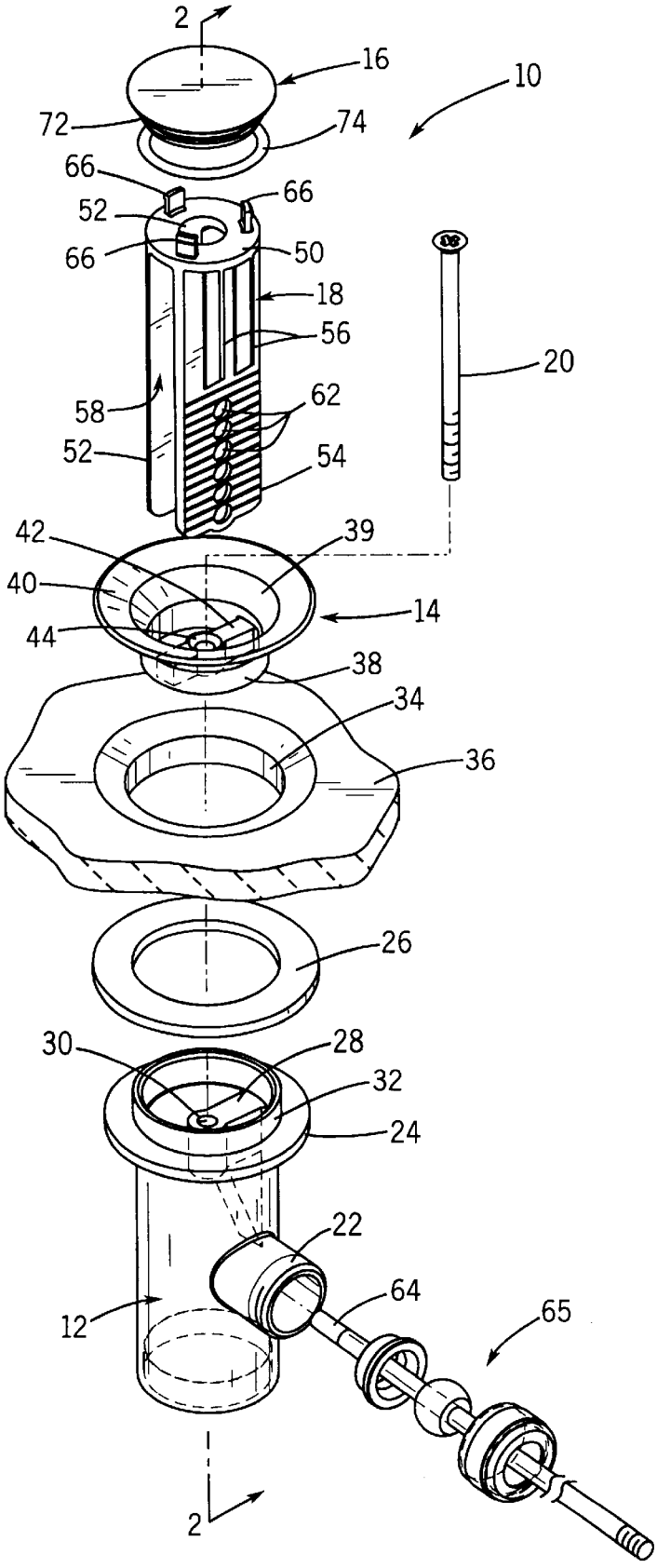
FIG. 1 is an exploded view of a drain assembly of the present invention.

Drain assembly 10 includes a main drain body 12, flange 14, a stopper 16, a stopper guide 18 and a threaded fastener 20. The drain body 12 is a tubular brass body having a radially extending nipple 22. An integral gasket support ring 24 extends around an upper end of the drain body 12 for supporting a rubber gasket 26. Also at the upper end of the drain body 12 is a cross-bar 28 extending laterally into the passageway of the drain body 12 having a threaded opening 30 at the axial centerline of the drain body 12.

An upper rim 32 of the drain body 12 is sized to fit inside of a conventional drain opening 34 of a sink or bathtub wash basin 36. Preferably, the rim 32 is fit into the drain opening 34 from beneath the basin 36 with the gasket 26 fit snugly around the drain body 12 and between the underside of the basin 36 and the gasket support ring 24. Friction will hold the drain body 12 in place temporarily until the rest of the assembly can be assembled from above the basin 36.

The drain flange 14 is preferably also brass and has a lower rim 38 sized to fit inside the upper rim 32 of the drain body 12 when it is inserted into the drain opening 34 from above the basin 36. The drain flange 14 has a frusto-conical surface 39 extending outwardly to a lip 40 with a diameter larger than the drain opening 34 to prevent it from falling through the drain opening 34. The drain flange 14 also has a cross-bar 42 extending between the lower rim 38 and having an opening 44 at the axial centerline of the drain flange 14. As described below, the drain flange cross-bar 42 is preferably aligned so that it rests along the length of the top of the drain body cross-bar 28. Such alignment minimizes the obstruction of the drain passageway. The lip 40 of the drain flange rests 14 on the upper side of the basin wall 36 and the openings 30 and 44 are aligned so that the threaded fastener 20 can be inserted therein and tightened to fasten the drain body 12 and drain flange 14 securely to the basin 36.

Rather than trying to fit one's fingers down into the relatively small drain opening 34, the drain flange 14 is preferably aligned using the stopper guide 18 before the stopper guide 18 is finally assembled. The stopper guide 18 is a suitable re-enforced plastic, such as 25% glass-filled acetyl. The stopper guide 18 has an annular upper end 50 with an axial opening 52 from which depend downwardly two generally planar axial legs 52 and 54 that are strengthened by four perpendicular gussets 56 (two at each leg 52 and 54). The legs 52 and 54 are spaced apart to define a slot 58 therebetween in communication with the axial opening 52. The legs 52 and 54 have corresponding sets of radial openings 60 and 62, respectively, through which a drain valve stem 64 of a conventional ball-type valve assembly 65 (see FIG. 1) is inserted at a selected point depending on the size of the fixture.

The stopper guide 18 can be used to align the drain flange 14 to the drain body 12 by inserting it into the drain opening 34 so that the legs 52 and 54 fit around the cross-bar 42. The stopper guide 18 can then be rotated until the drain flange cross-bar 44 aligns with the over drain body cross-bar 28. The stopper guide 18 can then be dropped down through the drain flange 14 opening so that it rests on the aligned cross-bars 28 and 42 and the threaded fastener 20 can be inserted through the axial opening 52 in the stopper guide 18 and into the openings 30 and 44 in the respective cross-bars 28 and 42. The fastener 20 can then be tightened to bring the drain body 12 and the drain flange 14 toward each other and against opposite sides the basin 36 to secure the assembly 10 to the basin 36.

Figure 2:
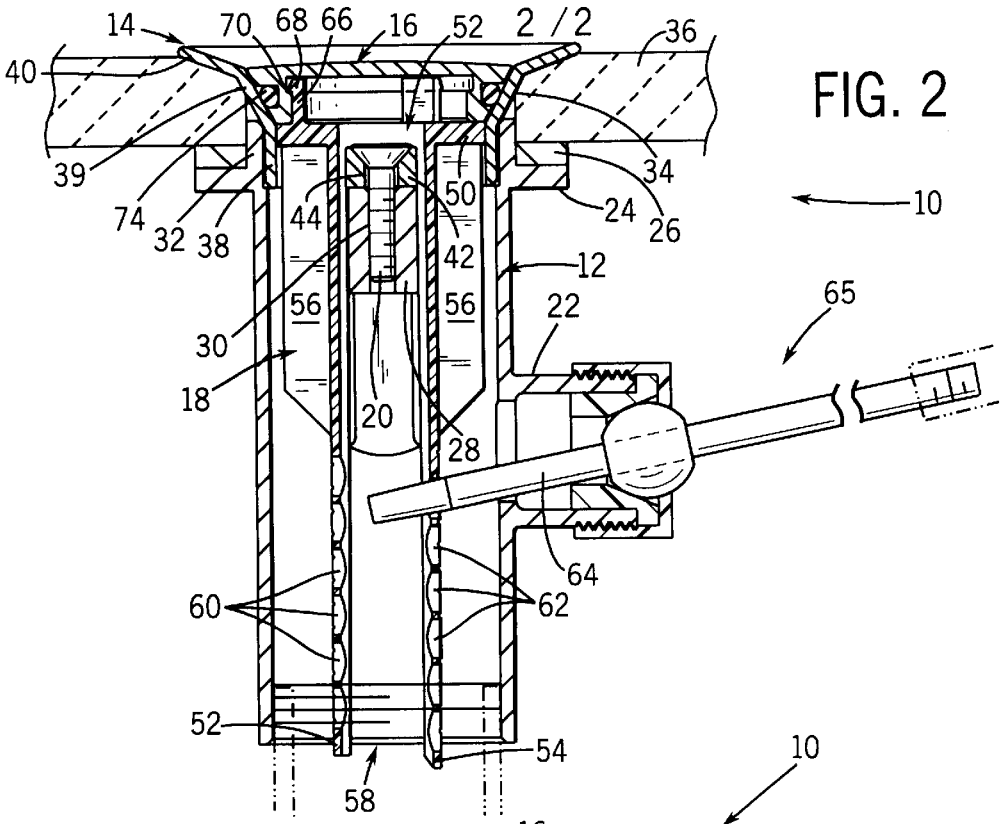
FIG. 2 is a cross-sectional view generally along line 2—2 of FIG. 1 (albeit in assembled form), with the drain stopper closing off the opening in a drain flange.

The stopper guide 18 can then be removed from the assembly for connecting the stopper 16. In particular, three deflectable fingers 66 extend upwardly from the upper end 50 of the stopper guide 18. The fingers 66 have upper latch ends 68 that engage with a circular catch surface 70 at the underside of the drain stopper 16 (see FIG. 2), thereby allowing the stopper 16 to be quickly snapped onto the upper end of the stopper guide 18. It should be noted that other suitable attachment techniques could be employed here, such as a threaded or a pin and slot connection.

The drain stopper is preferably disk-shaped and has a tapered circumference with a circumferential groove 72 for accommodating an o-ring 74. The o-ring 74 and circumferential wall of the stopper 16 are sized to fit tightly against the inner surface of the frusto-conical surface 39 of the drain flange 14 so that the o-ring 74 can make a water-tight seal to restrict flow through the drain flange 14 when in the position shown in FIG. 2.

Figure 3:
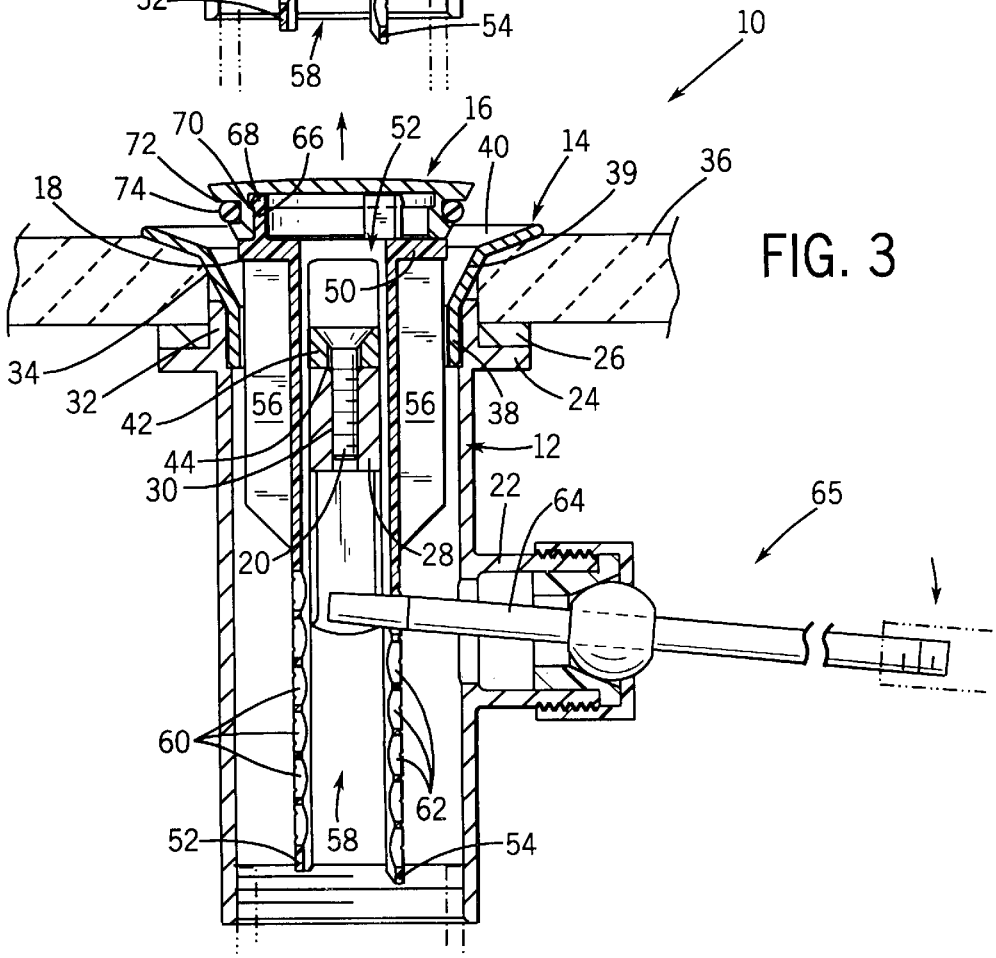
FIG. 3 is a view similar to FIG. 3, albeit with the stopper raised to allow the basin to be drained.

The stopper guide 18 (with the stopper 16 connected thereto) can then be reinserted into the drain opening for connection of the stopper guide 18 to the valve stem 64 of the valve assembly 65 by inserting the valve stem 64 into one or both openings 60 and 62 at the appropriate height of the stopper guide legs 52 and 54. If desired, prior to final assembly, the stopper guide 18 can be removed so that the legs 52 and 54 can be trimmed to remove any excess length. In any event, a suitable drain pull (not shown) linked to the valve assembly 65 can then be used to position the stopper guide 18 (and thus the stopper 16). In particular, the stopper 16 guide 18 can be lowered (as in FIG. 2) to close off the drain and raised (as in FIG. 3) to open the drain.

Thus, the present invention provides a drain assembly having a pop-up stopper operable by a drain valve lever mechanism that can be quickly and easily installed to a basin, primarily from above the basin. The unique stopper guide can be used during installation to align the drain flange and drain body and can hold them in the proper alignment while be secured together and to the basin. The stopper guide can then be removed so that the stopper can quickly be snapped or threaded onto its upper end and then dropped back into the drain opening ready for use.

While a specific embodiment has been shown, various modifications falling within the breadth and scope of the invention will be apparent to one skilled in the art. Thus, the following claims should be looked to in order to understand the full scope of the invention.

INDUSTRIAL APPLICABILITY

Disclosed is a top mount drain assembly having a movable stopper guide that can be used to aid in installing the assembly to the basin.

I claim:

1. A pop-up drain valve assembly for controlling flow through a drain opening of a basin, comprising:

a drain body having an upper rim and a laterally extending cross-member with an opening therein;

a drain control element positioned in the drain body;

a flange having a bottom rim and a laterally extending cross-member with an opening positioned in alignment with the cross-member opening of the drain body;

an axial fastener simultaneously positioned in the aligned flange opening and drain body opening;

a stopper guide having an axial opening for accommodating the fastener and being axially movable in the flange and drain body, wherein the stopper guide has a pair of downwardly extending legs defining an axial slot there between, said pair of legs sandwiching the flange and drain body cross members and guiding them into alignment, at least one of said legs connected to said drain control element at a selected point of that leg; and a stopper connected to an upper portion of the stopper guide and sized to seal against the flange.

2. The drain assembly of claim 1, wherein the drain body defines a gasket support area at its upper end around the upper rim.

3. The drain assembly of claim 1, wherein an upper end of the stopper guide has a connection member for engaging the stopper.

4. The drain assembly of claim 3, wherein the connection member permits removably securing the stopper to the stopper guide.

5. The drain assembly of claim 4, wherein the connection member includes a plurality of upwardly extending fingers having latch surfaces for engaging catch surfaces on the underside of the stopper.

6. The drain assembly of claim 1, wherein the stopper guide is plastic.

7. A method of installing a drain assembly in a drain opening of a basin, comprising the steps of:

temporarily mounting a drain body to the drain opening from beneath the basin, said drain body having an upper rim and a laterally extending cross-member with an opening therein;

inserting a drain flange into the drain opening from above the basin, said drain flange having a bottom rim and a laterally extending cross-member with an opening positioned in alignment with the cross-member opening of the drain body;

aligning the drain flange to the drain body by inserting a stopper guide into the drain opening and rotating the drain flange with the stopper guide, the stopper guide having an axial opening for accommodating the fastener and being axially movable in the flange and drain body, wherein the stopper guide has a pair of downwardly extending legs defining an axial slot there between, said aligning step comprising said pair of legs sandwiching the flange and drain body cross members and guiding them into alignment;

fastening the drain flange and the drain body to the basin with an axial fastener inserted through the axial opening in the stopper guide;

connecting a stopper onto an upper end of the stopper guide; and linking a drain control element to the stopper guide.

8. The method of claim 7, further comprising the steps:

removing the stopper guide after fastening the drain flange and body to the basin to facilitate connecting the stopper to the upper end the stopper guide; and reinserting the stopper guide into the drain opening.

* * * * *

UNITED STATES PATENT AND TRADEMARK OFFICE

CERTIFICATE OF CORRECTION

PATENT NO. : 6,367,102 B1
DATED : April 9, 2002
INVENTOR(S) : Mark F. McMullen

It is certified that error appears in the above-identified patent and that said Letters Patent is hereby corrected as shown below:

Column 2,
Line 4, "on" should be -- one --;
Line 40, change second instance of "FIG. 3" to -- FIG. 2 --.

Signed and Sealed this

Twenty-first Day of January, 2003

JAMES E. ROGAN
*Director of the United States Patent and Trademark Office*